US006752050B2

(12) United States Patent
Hu

(10) Patent No.: US 6,752,050 B2
(45) **Date of Patent: *Jun. 22, 2004**

(54) WRENCH WITH A FIXED MAXIMUM OPERATIONAL TORQUE

(76) Inventor: Bobby Hu, 8F, No. 536~1, Ta Chin Street, Taichung (TW)

( * ) Notice: Subject to any disclaimer, the term of this patent is extended or adjusted under 35 U.S.C. 154(b) by 110 days.

This patent is subject to a terminal disclaimer.

(21) Appl. No.: 10/046,114

(22) Filed: Jan. 7, 2002

(65) Prior Publication Data

US 2003/0079579 A1 May 1, 2003

(30) Foreign Application Priority Data

Oct. 29, 2001 (TW) ..... 90218719 U

(51) Int. Cl.[7] ..... B25B 23/14
(52) U.S. Cl. ..... 81/467; 81/476; 81/473
(58) Field of Search ..... 81/467, 473–476

(56) References Cited

U.S. PATENT DOCUMENTS

| | | | | |
|---|---|---|---|---|
| 2,157,574 A | | 5/1939 | Siesel | |
| 2,300,652 A | | 11/1942 | Cooney | |
| 2,332,971 A | | 10/1943 | Johnson | |
| 2,396,027 A | | 3/1946 | Spayd | |
| 2,601,044 A | | 6/1952 | Mayer | |
| 2,768,547 A | | 10/1956 | Noell | |
| 2,826,107 A | | 3/1958 | Woods | |
| 2,924,134 A | * | 2/1960 | Harmes | 81/467 |
| 2,972,271 A | | 2/1961 | Gill | |
| 3,593,542 A | | 7/1971 | Urayama | |
| 3,651,718 A | | 3/1972 | Thomasian | |
| 4,238,978 A | | 12/1980 | Leone | |
| 4,308,770 A | | 1/1982 | MacDonald | |
| 5,152,200 A | | 10/1992 | Kaplan | |
| 5,822,830 A | | 10/1998 | Lin | |
| 6,029,551 A | * | 2/2000 | Wu | 81/475 |
| 6,076,439 A | | 6/2000 | Dzieman | |
| 6,155,147 A | * | 12/2000 | Dzieman | 81/473 |
| 6,439,086 B1 | | 8/2002 | Bahr | |
| 6,487,943 B1 | * | 12/2002 | Jansson et al. | 81/475 |
| 6,502,483 B1 | | 1/2003 | Swank et al. | |
| 2003/0010162 A1 | | 1/2003 | Hu | |
| 2003/0010163 A1 | | 1/2003 | Hu | |
| 2003/0079577 A1 | | 5/2003 | Hu | |
| 2003/0079578 A1 | | 5/2003 | Hu | |
| 2003/0205114 A1 | | 11/2003 | Hu | |
| 2003/0205115 A1 | | 11/2003 | Hu | |

* cited by examiner

*Primary Examiner*—Lee D. Wilson
(74) *Attorney, Agent, or Firm*—Alan D. Kamrath; Nikolai & Mersereau, P.A.

(57) ABSTRACT

A wrench includes a rod, a retainer, a pressing member, and a casing for receiving the retainer and the pressing member. The rod includes a driving portion on an end thereof for engaging with a fastener. The retainer has a central portion securely mount to the rod to turn therewith. The pressing member is turned together with the casing when the casing is turned. The pressing member has at least one engaging member that is biased to selectively engage with one of plural retaining sections of the retainer, thereby exerting an engaging force between each of the ends of the pressing member and an associated one of the retaining sections of the retainer. When a rotational force applied to the casing is smaller than the engaging force, the retainer and the rod are turned to thereby turn the fastener.

39 Claims, 14 Drawing Sheets

WRENCH WITH A FIXED MAXIMUM OPERATIONAL TORQUE

BACKGROUND OF THE INVENTION

1. Field of the Invention

The present invention relates to a wrench with a fixed maximum operational torque to prevent damage to the object secured by a fastener driven by the wrench. The present invention also relates to a wrench with a fixed maximum operational torque, wherein damage to the object secured by a fastener driven by the wrench is avoided when the wrench is turned in a direction, and wherein the fastener is forced to turn when the wrench is turned in a reverse direction.

2. Description of the Related Art

FIG. 16A of the drawings illustrates a conventional wrench 1 having a hexagonal driving portion with six planar faces 2 for engaging with six faces of a hexagonal groove in a top face of a fastener. However, slide tends to occur between the planar faces of the driving portion of the wrench 1 and the faces of the fastener. FIG. 16B illustrates a so-called TROX wrench 3 having plural arcuate faces 4 for engaging with corresponding arcuate faces in a top face of a fastener. Such a TROX wrench 3 is used to tighten important parts of a car and cutting tools. As illustrated in FIG. 17, a blade 7 is tightened to a cutting tool 5 by a bolt 6. However, the expensive blade 7 tends to be damaged when the bolt 6 is excessively tightened. But the blade 7 could fly away and thus cause injury if the bolt 6 is not tightened to the desired extent.

SUMMARY OF THE INVENTION

An object of the present invention is to provide a wrench with a fixed maximum operational torque such that when the torque applied by the user is greater than the maximum operational torque, the wrench slides and the fastener is not turned. Thus, damage to the object secured by the fastener is prevented.

Another object of the present invention is to provide a wrench with a fixed maximum operational torque that can be altered in response to the actual use.

A further object of the present invention is to provide a wrench with a fixed maximum operational torque, wherein damage to the object secured by a fastener driven by the wrench is avoided when the wrench is turned in a direction, and wherein the fastener is forced to turn when the wrench is turned in a reverse direction.

In accordance with a first aspect of the invention, a wrench comprises:

a rod comprising a driving portion on an end thereof for engaging with a fastener;

a retainer having a central portion securely mounted to the rod to turn therewith, the retainer including at least two pairs of retaining sections on a side thereof;

a casing comprising a receiving section for accommodating the retainer and allowing relative rotational movement between the casing and the retainer, the casing further comprising a compartment communicated with the receiving section;

a pressing member received in the compartment of the casing and slidable along a longitudinal direction of the rod, the pressing member being turned together with the casing when the casing is turned; and means for biasing two ends of the pressing member to respectively engage with one pair of the retaining sections of the retainer, thereby exerting an engaging force between each of the ends of the pressing member and an associated one of the retaining sections of the retainer;

wherein when a rotational force applied to the casing is smaller than the engaging force, the retainer and the rod are turned to thereby turn the fastener; and wherein when the rotational force applied to the casing is greater than the engaging force, the casing and the pressing member slide while the retainer and the rod are not turned.

In accordance with a second aspect of the invention, a wrench comprises:

a rod comprising a driving portion on an end thereof for engaging with a fastener;

a retainer having a central portion securely mounted to the rod to turn therewith, the retainer including a plurality of annularly spaced retaining sections on a side thereof;

a casing comprising a receiving section for accommodating the retainer and allowing relative rotational movement between the casing and the retainer, the casing further including a compartment communicated with the receiving section;

a pressing member received in the compartment of the casing and slidable along a longitudinal direction of the rod, the pressing member being turned together with the casing when the casing is turned, the pressing member including at least one engaging member; and means for biasing said at least one engaging member of the pressing member to selectively engage with at least one of the retaining sections of the retainer, thereby exerting an engaging force between said at least one engaging member of the pressing member and said at least one of the retaining sections of the retainer;

wherein when a rotational force applied to the casing is smaller than the engaging force, the retainer and the rod are turned to thereby turn the fastener; and wherein when the rotational force applied to the casing is greater than the engaging force, the casing slides and said at least one engaging member slides to another one of the retaining sections of the retainer while the retainer and the rod are not turned. (FIGS. 2, 9, 11, 15)

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
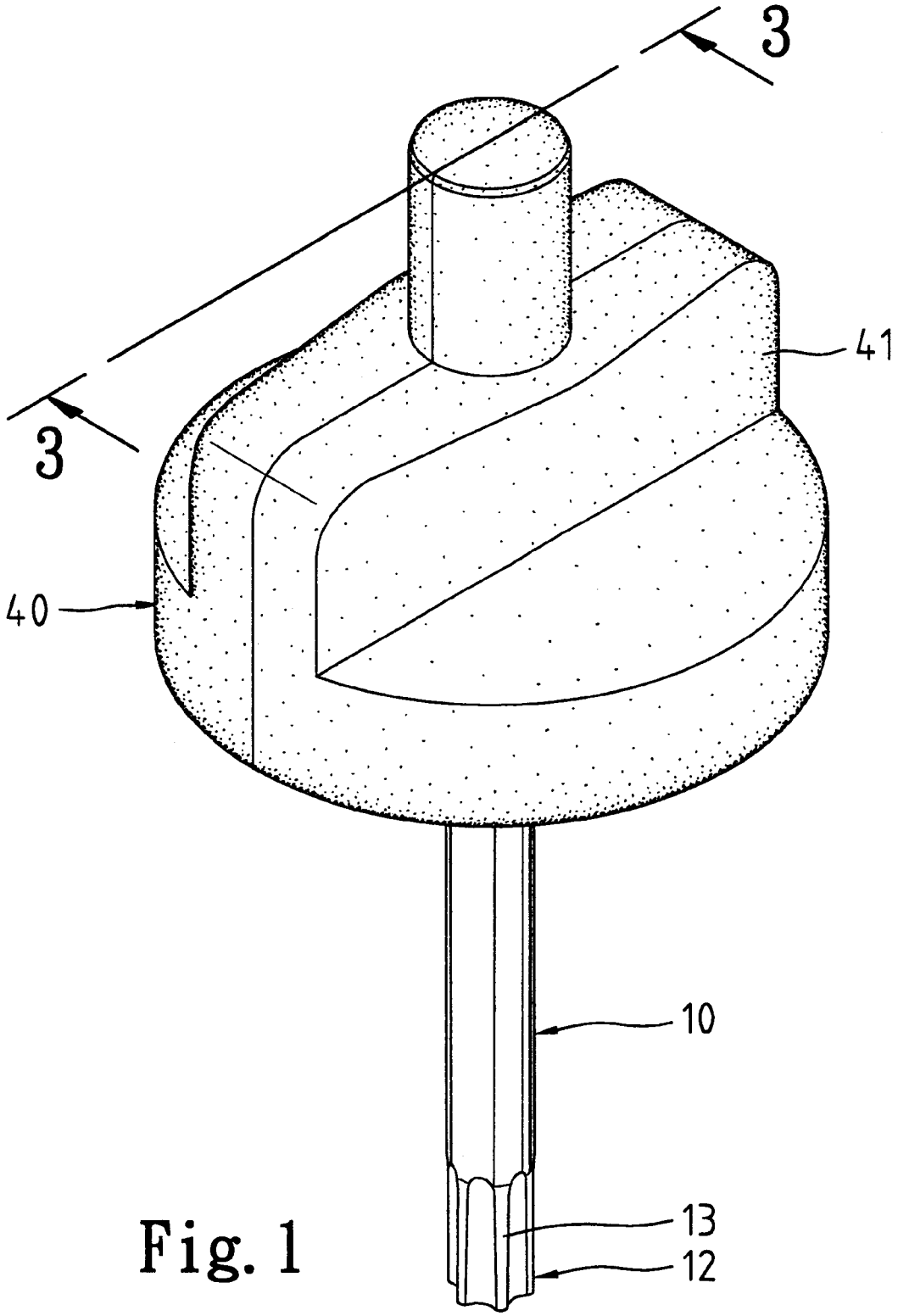
FIG. 1 is a perspective view of a wrench in accordance with the present invention.
Figure 2:
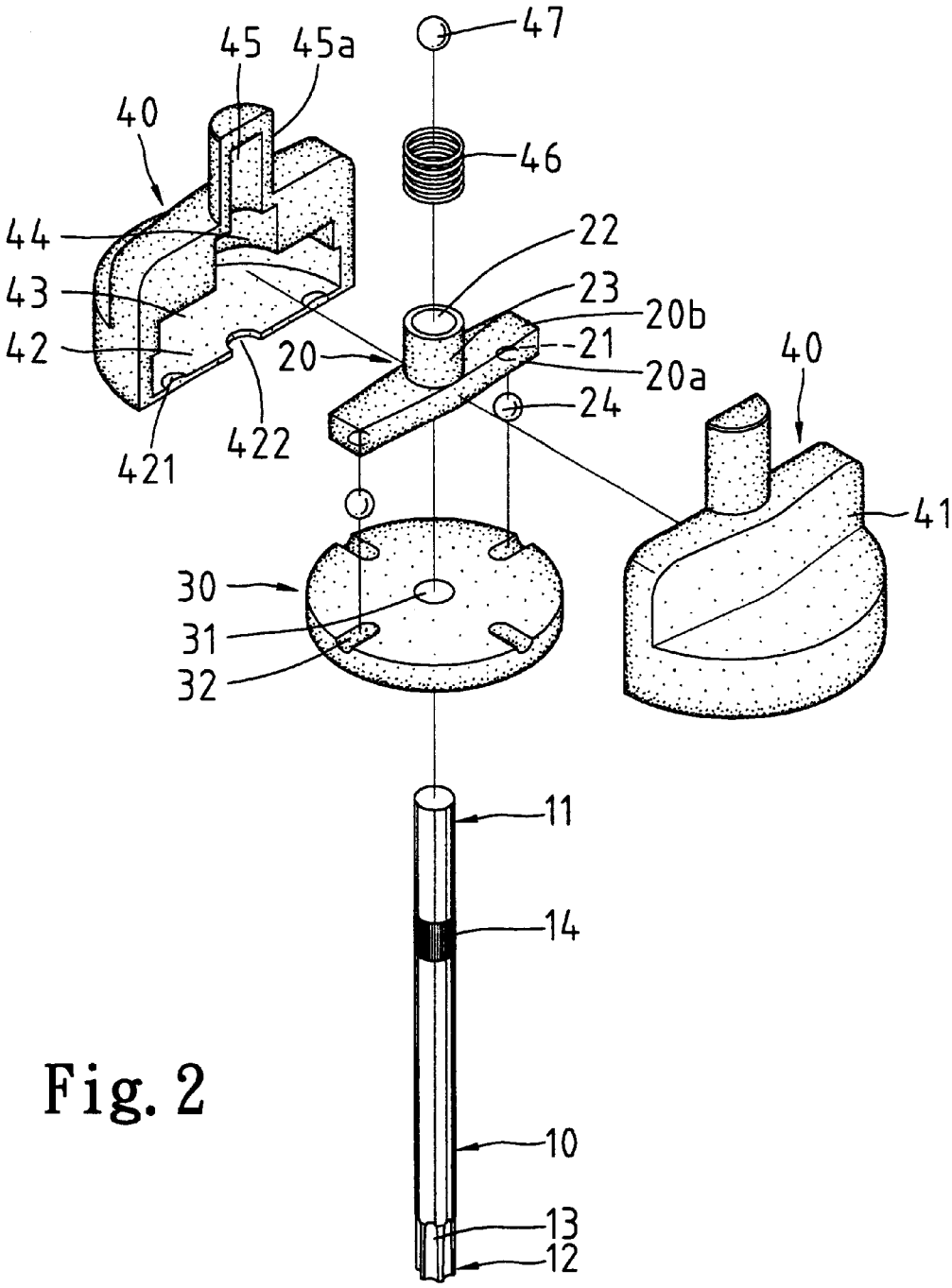
FIG. 2 is an exploded perspective view of the wrench in accordance with the present invention.

Referring to FIGS. 1 and 2, a wrench in accordance with the present invention generally includes a rod 10, a pressing member 20, a retainer 30, and a casing 40. The rod 10 comprises a first end 11 and a second end 12 with a driving portion 13 for engaging with a fastener. In this embodiment, the driving portion 13 is shaped as a TROX type wrench. The rod 10 further has an embossed section 14 that is preferably adjacent to the first end 11 thereof.

The pressing member 20 includes a first side 20*a* having a groove 21 in each of two ends thereof and a second side 20*b*. An extension 23 projects from a center of the second side 20*b*. A through-hole 22 extends through the extension 23 and the pressing member 20.

The retainer 30 is in the form of a circular disc and includes a central hole 31 and at least two pairs of diametrically opposed retaining sections (e.g., grooves 32). The central hole 31 of the retainer 30 is engaged with the embossed section 14 of the rod 10. Thus, the retainer 30 and the rod 10 rotate jointly.

Figure 3:
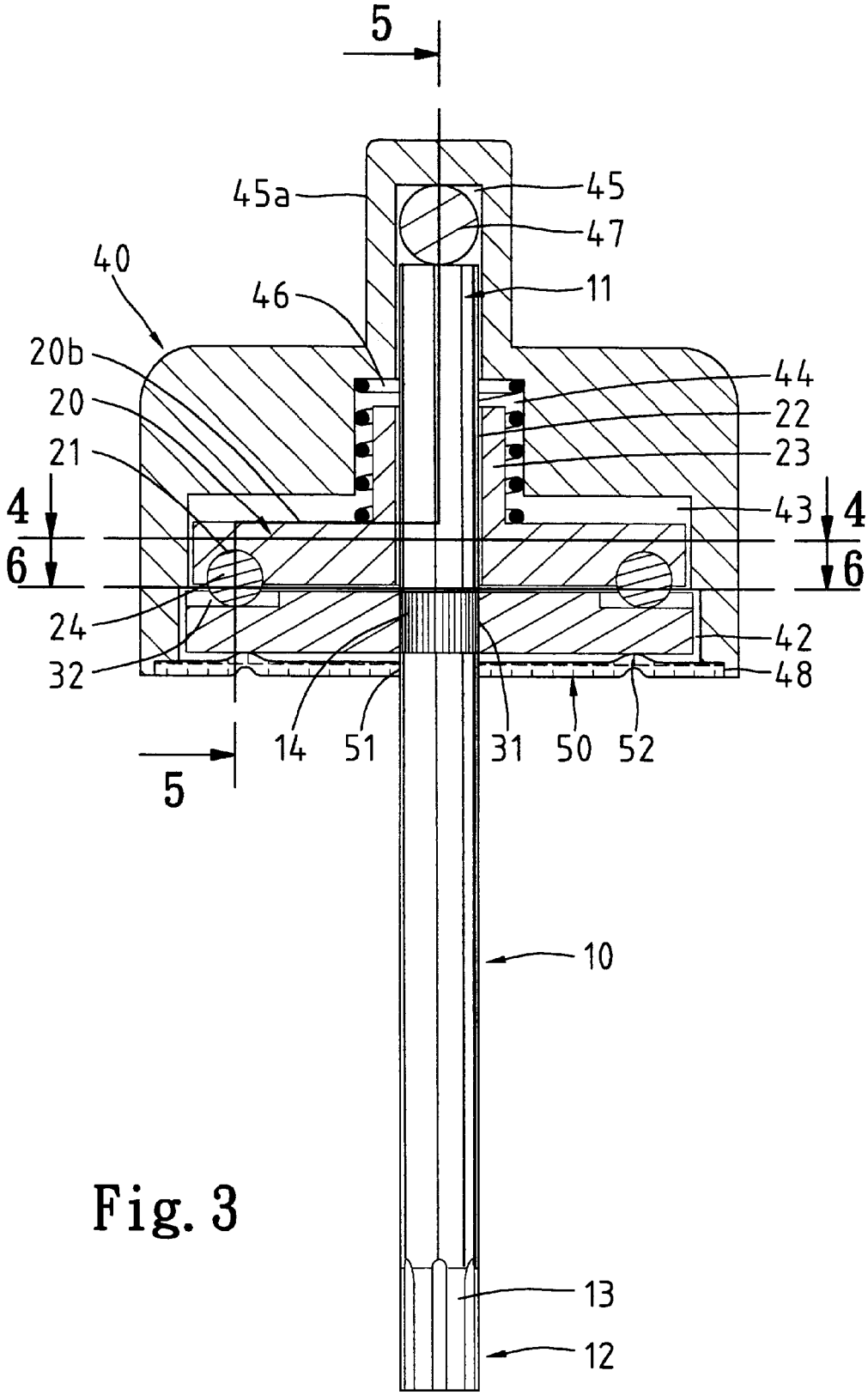
FIG. 3 is a sectional view taken along plane 3—3 in FIG. 1.

The casing 40 comprises a grip portion 41 for manual turning operation. A receiving section 42 is defined in the casing 40 for accommodating the retainer 30 while allowing relative rotational movement between the casing 40 and the retainer 30. Referring to FIGS. 2 and 3, the pressing member 20 is slidably received in a compartment 43 that is located above the receiving section 42. A positioning hole 45 is defined in a center of casing 40 and communicated with the compartment 43 and the receiving section 42. The rod 10 is extended through the receiving section 42 and the compartment 43 with the first end 11 of the rod 10 being received in the positioning hole 45 of the casing 40. A ball 47 is provided between an end face of the first end 11 of the rod 10 and an end wall defining a portion of the positioning hole 45 of the casing 40 to provide a smooth rotation therebetween. The positioning hole 45 includes an enlarged section 44 for receiving the extension 23 of the pressing member 20. Biasing means is provided to urge the pressing member 20 to press against the retainer 30. In this embodiment, an elastic element 46 is mounted around the extension 23 with an end of the elastic element 46 being attached to an end face defining the enlarged section 44 and with the other end of the elastic element 46 being attached to the second side 20*b* of the pressing member 20. An engaging member (e.g., a ball 24) is provided between each groove 21 of the pressing member 20 and an associated one of the grooves 32 of the retainer 30. A recessed portion 48 surrounds the receiving section 42 of the casing 40. In this embodiment, a cylindrical member 45*a* projects from a side of the casing 40 and defines a portion of the positioning hole 45 that receives the first end 11 of the rod 10 and the ball 47, best shown in FIG. 3. A bottom wall defining the receiving section 42 includes two protrusions 421 for supporting the retainer 30, thereby allowing smooth rotation between the casing 40 and the retainer 30. The bottom wall defining the receiving section 42 further includes a hole 422 through which the rod 10 extends. The casing 40 in this embodiment is comprised of two casing halves.

Figure 4:
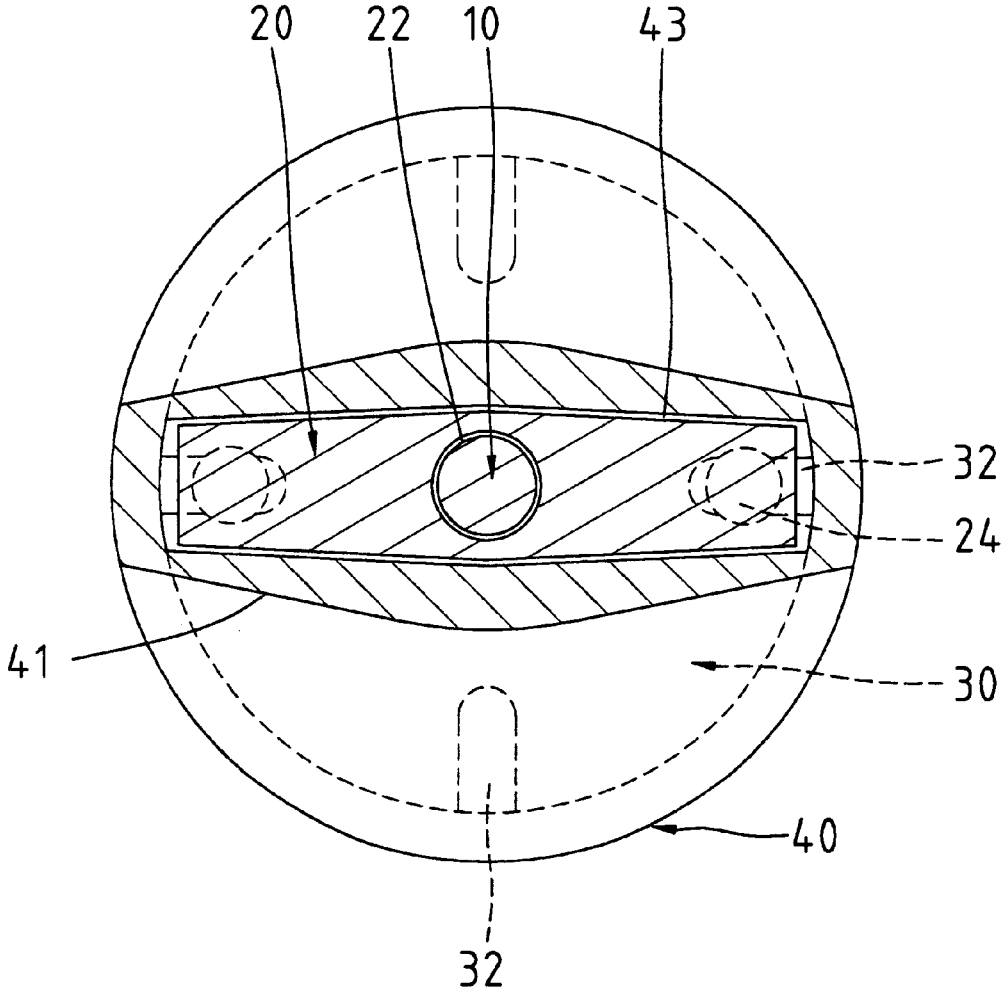
FIG. 4 is a sectional view taken along plane 4—4 in FIG. 3.
Figure 5:
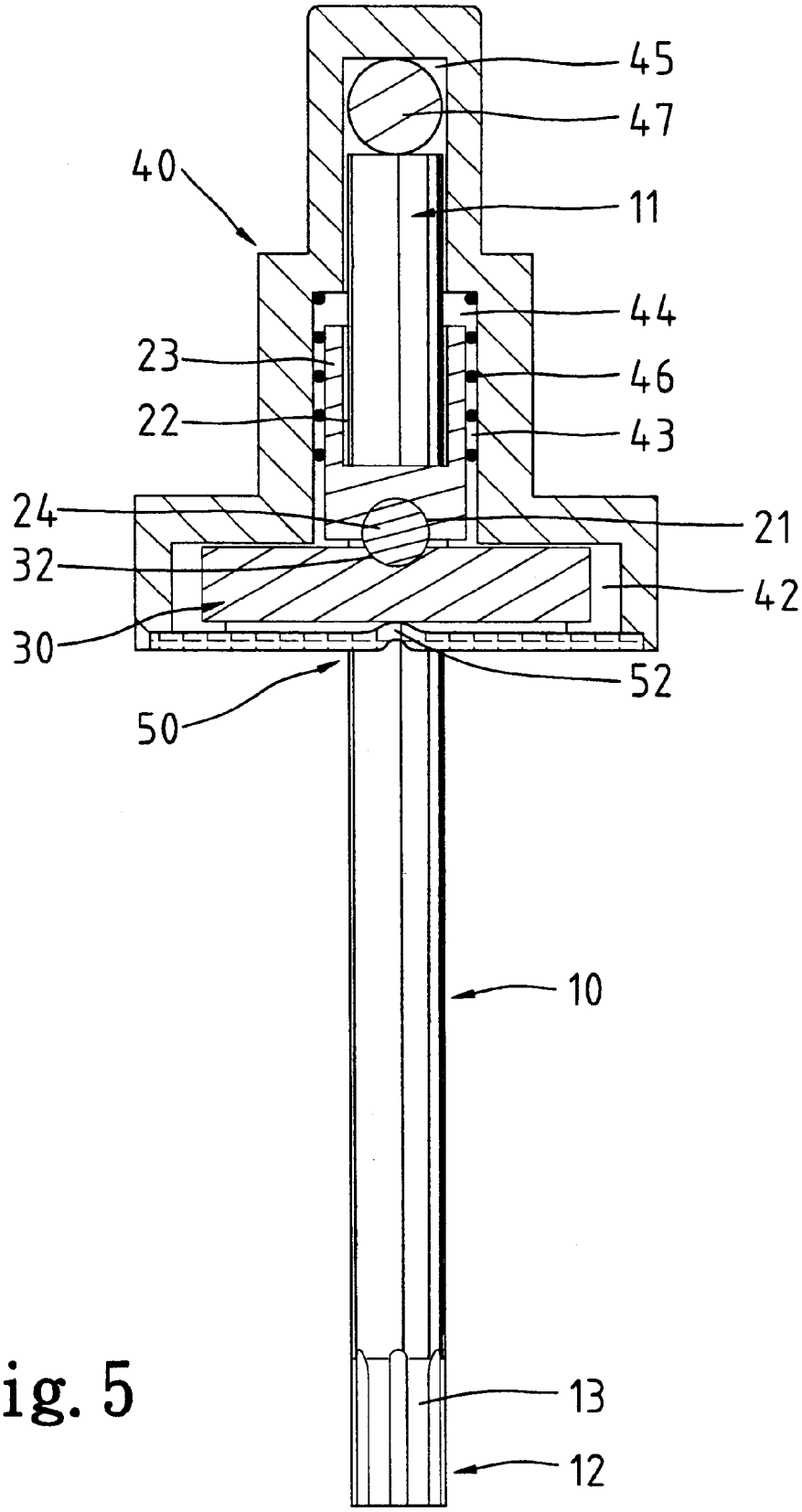
FIG. 5 is a sectional view taken along plane 5—5 in FIG. 3.

Referring to FIGS. 3 through 5, each ball 24 is biased by the elastic element 46 to press against a bottom wall defining an associated one of the grooves 32 of the retainer 30. Namely, a predetermined engaging force exists between each ball 24 and the bottom wall defining the associated groove 32 of the retainer 30 under the action of the elastic element 46. The pressing member 20 turns together with the casing 40 when the latter is turned.

Figure 6:
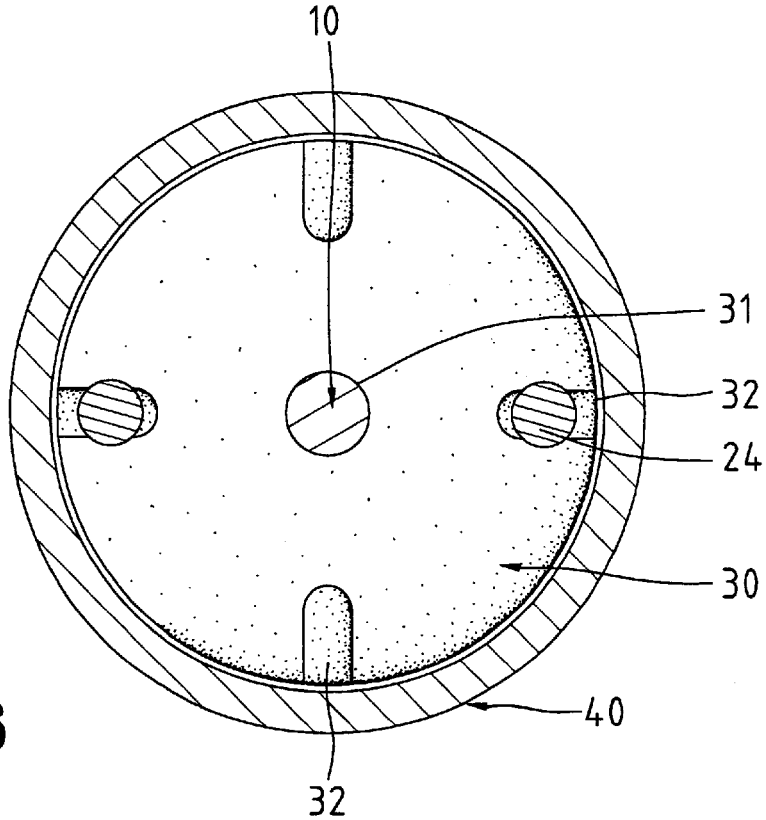
FIG. 6 is a sectional view taken along plane 6—6 in FIG. 3.

When driving a TROX type bolt (not shown) for a cutting tool (not shown), the driving portion 13 of the second end 12 of the rod 10 is engaged with the bolt, and the casing 40 is then turned by means of gripping and turning the grip portion 41. Referring to FIGS. 5 and 6, when the rotational force applied to the wrench is smaller than the predetermined engaging force between each ball 24 and the bottom wall defining the associated groove 32 of the retainer 30, the retainer 30 and the rod 10 turn together with the casing 40 to thereby drive the bolt.

Figure 8:
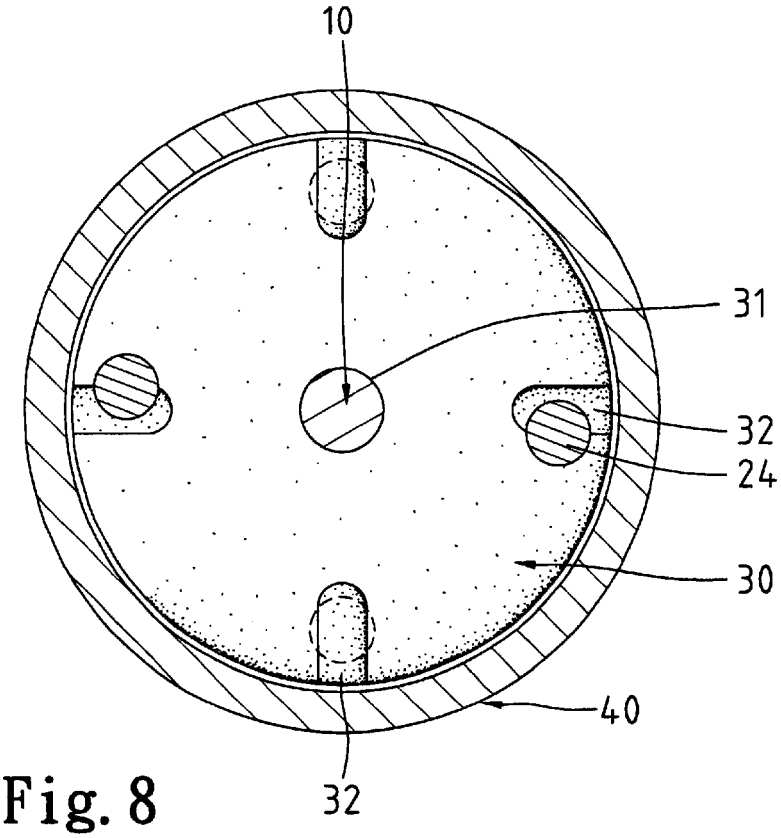
FIG. 8 is a view similar to FIG. 6, illustrating operation of the wrench in accordance with the present invention.
Figure 7:
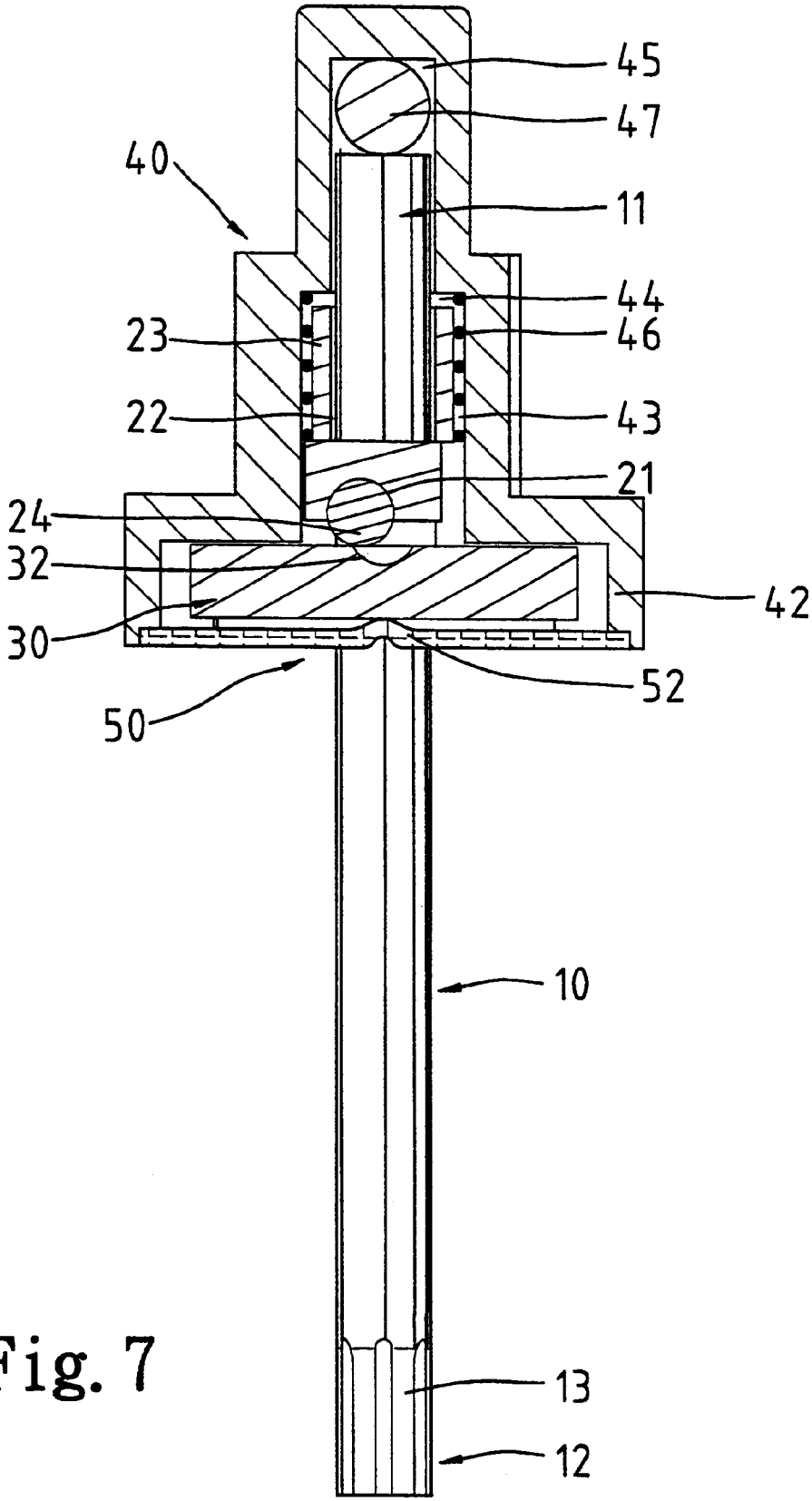
FIG. 7 is a view similar to FIG. 5, illustrating operation of the wrench in accordance with the present invention.

When the rotational force applied to the wrench is greater than the predetermined engaging force between each ball 24 and the bottom wall defining the associated groove 32 of the retainer 30, as illustrated in FIG. 7, the elastic element 46 is compressed to absorb the excessive amount of rotational force. Since the elastic element 46 is compressed, a sliding action is generated between each ball 24 and the bottom wall defining the associated groove 32 of the retainer 30. Each ball 24 is thus disengaged from the associated groove 32 of the retainer 30, and the casing 40 and the pressing member 20 slide relative to the retainer 30; namely, the retainer 30 and the rod 10 are not turned. As a result, the bolt is not turned. When the casing 40 is further turned, each ball 24 is moved to the next groove 32, as indicated by the phantom lines in FIG. 8. A "click" is generated when each ball 24 enters the next groove 32 under the action of the elastic element 46. The "click" also reminds the user of tightening of the bolt. The protrusions 421 of the casing 40 allow smooth relative rotational movement between the casing 40 and the retainer 30. Thus, the casing 40 turns freely if the rotational force is greater than the engaging force.

It is noted that the engaging force, which largely depends on the elastic coefficients of the elastic element 461, determines a maximum operational torque for turning the rod 10. Namely, when the torque applied to the casing 40 is smaller than the maximum operational torque, the retainer 30 and the rod 10 are turned, and when the torque applied to the casing 40 is greater than the maximum operational torque, the retainer 30 and the rod 10 are not turned. During tightening of the bolt, the bolt before being tightened is turned by means of applying a torque smaller than the maximum operational torque. When the bolt is tightened, the torque required to turn the casing 40 would be greater than the maximum operational torque such that the casing 40 slides. Thus, the user will notice the sliding motion of the casing 40 and be aware of tightening of the bolt. A "click" is generated when each ball 24 enters the next groove 32 under the action of the elastic element 46. The "click" also reminds the user of tightening of the bolt. The protrusions 421 of the casing 40 allow smooth relative rotational movement between the casing 40 and the retainer 30. Damage to the bolt and the cutting tool resulting from over-tightening is avoided. The maximum operational torque can be altered by means of selecting elastic elements of different elastic coefficients. The maximum operational torque is a constant and thus allows accurate operation. This advantageous design can be used in a limited space, and the manufacturing cost of the wrench is largely reduced.

Figure 9:
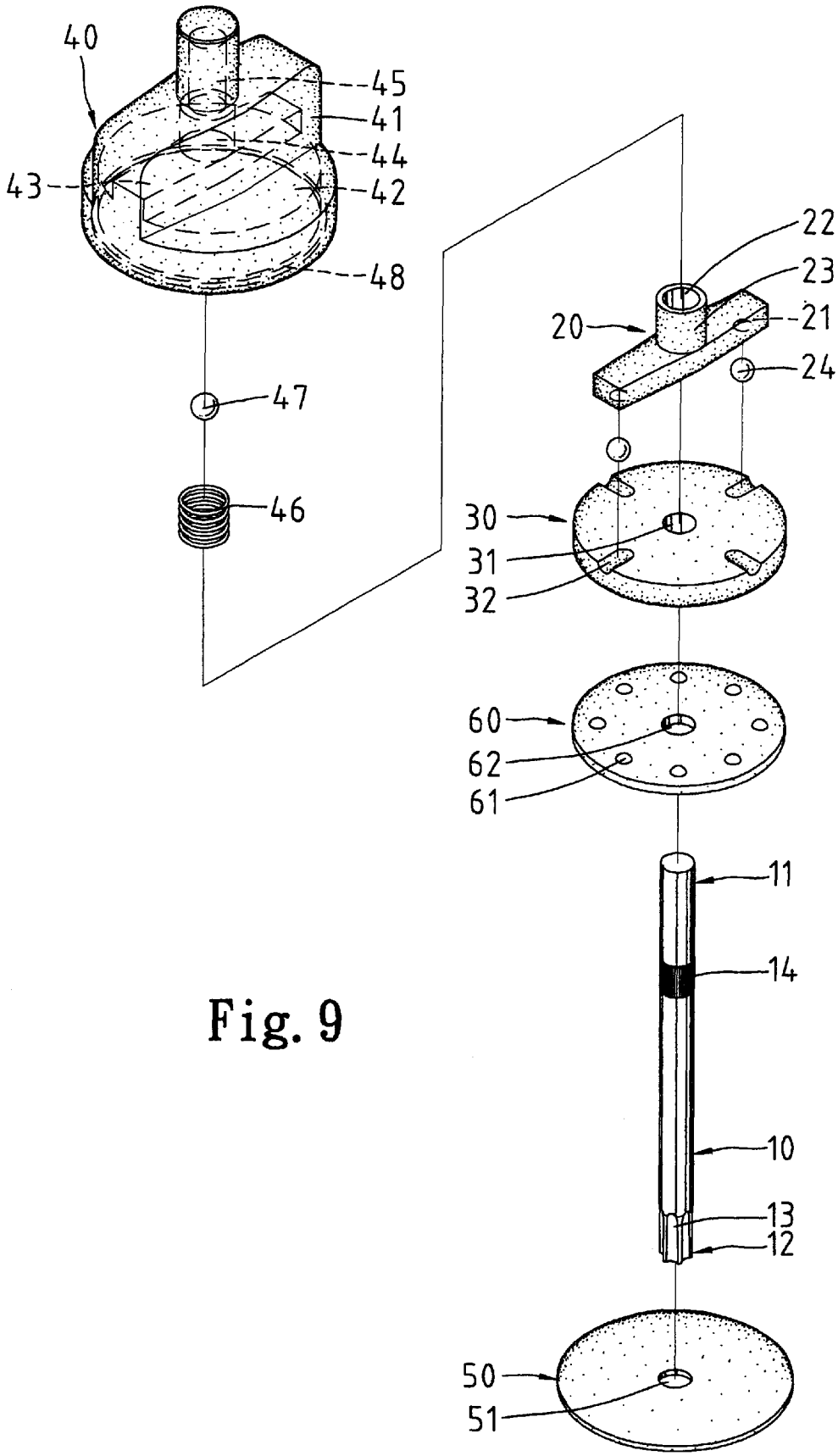
FIG. 9 is an exploded perspective view of a modified embodiment of the wrench in accordance with the present invention.
Figure 10:
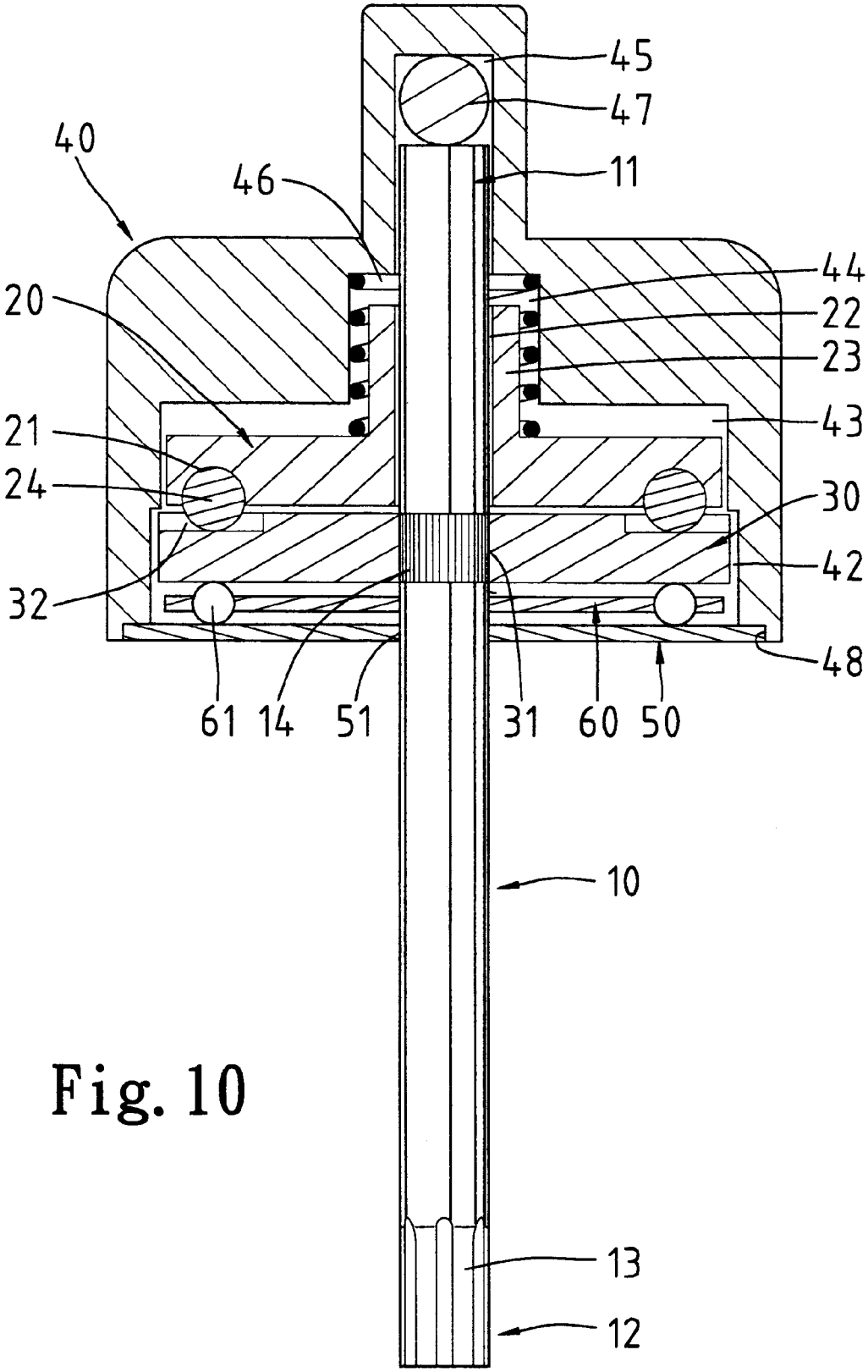
FIG. 10 is a sectional view of the modified embodiment in FIG. 9.

FIGS. 9 and 10 illustrate a modified embodiment of the wrench in accordance with the present invention. This modified embodiment is almost identical to the first embodiment except that the casing 40 is an integral member having an open bottom end. In this embodiment, a recessed portion 48 surrounding the receiving section 42 receives the retainer 30. In addition, a support plate 60 is mounted in the receiving section 42 and includes plural protrusions 61 for supporting the retainer 30, thereby allowing smooth rotation between the casing 40 and the retainer 30. The support plate 60 includes a central hole 62 through which the rod 10 extends. A lid 50 is securely mounted in the recessed portion 48 of the casing 40 to close the casing 40. The lid 50 includes a hole 51 through which the rod 10 extends. Operation of this embodiment is identical to that of the first embodiment.

Figure 11:
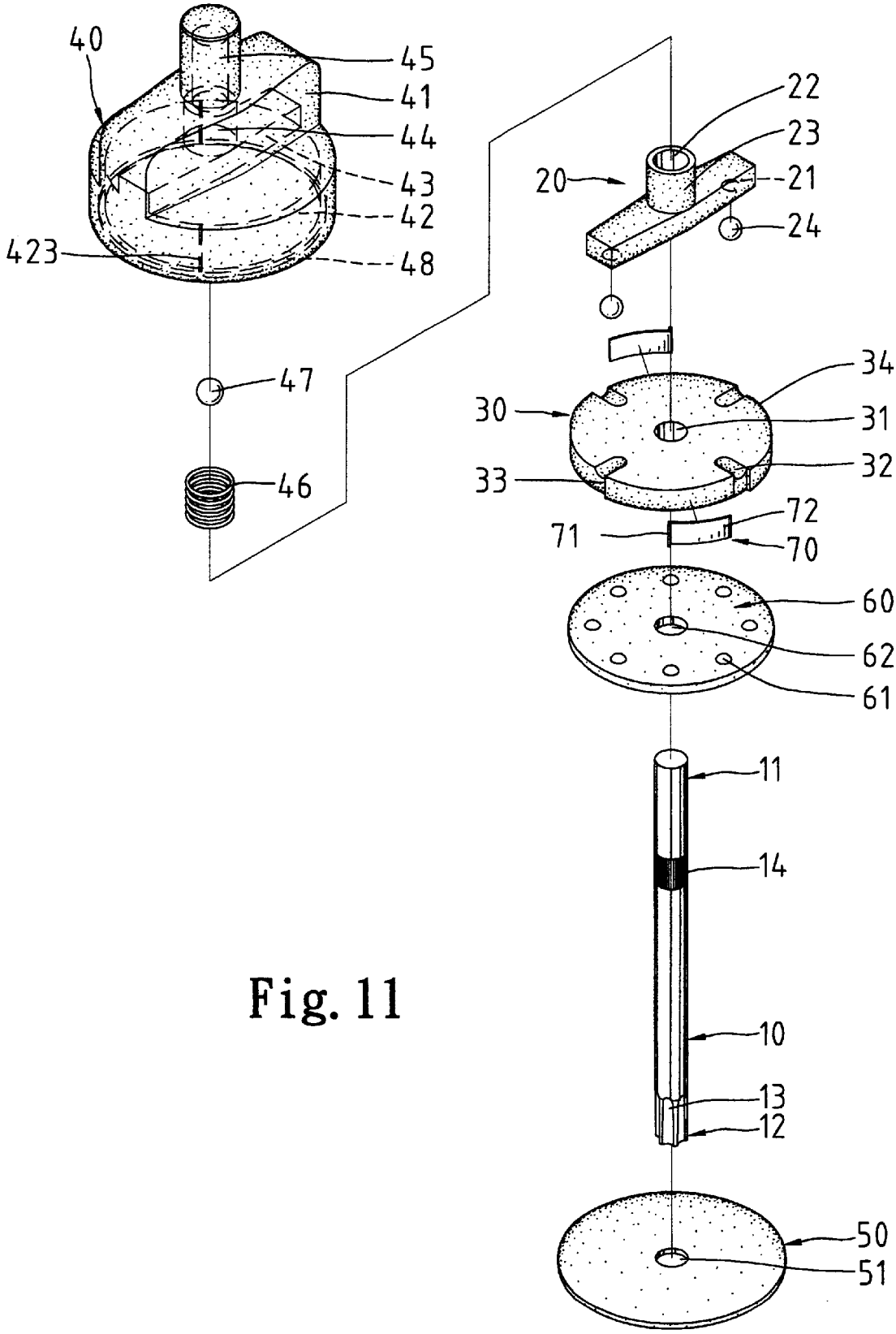
FIG. 11 is an exploded perspective view of another modified embodiment of the wrench in accordance with the present invention.

FIG. 11 illustrates another embodiment of the wrench that is modified from the second embodiment of FIG. 9. In this embodiment, the casing 40 further includes two positioning slits 423 in a peripheral wall of the receiving section 42. Preferably, the positioning slits 423 are diametrically disposed. In addition, two stop members 70 are mounted in the receiving section 42 of the casing 40. Each stop member 70 includes a first end 71 fixed in an associated one of the slits 423 and a second end 72 extending into the receiving section 42 and extending along a periphery wall of the receiving section 42 of the casing 40. Further, the retainer 30 includes plural stop sections 33 on an outer periphery 34 thereof.

When driving a TROX type bolt (not shown) for a cutting tool (not shown), the driving portion 13 of the second end 12 of the rod 10 is engaged with the bolt, and the casing 40 is then turned, e.g., clockwise, by means of gripping and turning the grip portion 41. When the rotational force applied to the wrench is smaller than the predetermined engaging force between each ball 24 and the bottom wall defining the associated groove 32 of the retainer 30, the retainer 30 and the rod 10 turn together with the casing 40 to thereby drive the bolt (c.f. FIGS. 3, 4, 5, 6, and 10). It is noted that each stop member 70 and the stop sections 33 of the outer periphery 34 of the retainer 30 are configured that the stop member 70 slides across the stop sections 33 when the casing 40 is turned clockwise.

Figure 13:
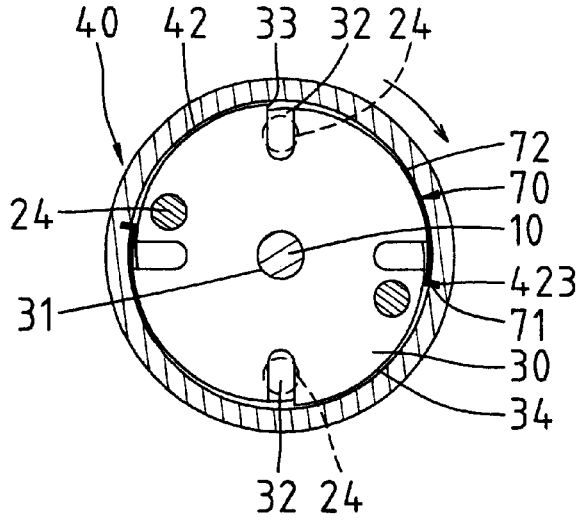
FIG. 13 is a view similar to FIG. 12, illustrating operation of the wrench in FIG. 11.
Figure 12:
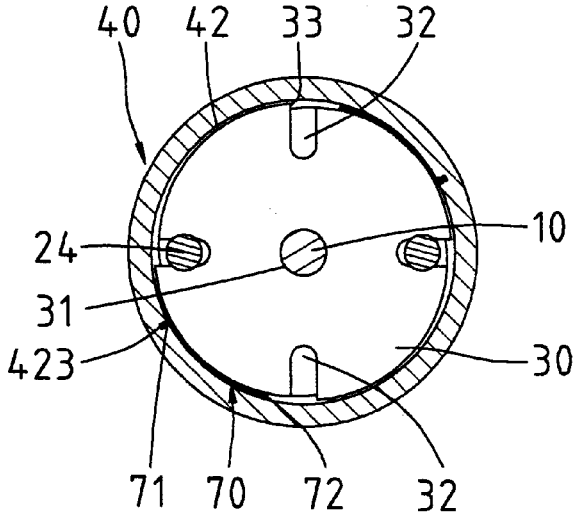
FIG. 12 is a sectional view of the embodiment of FIG. 11.

When the rotational force applied to the wrench is greater than the predetermined engaging force between each ball 24 and the bottom wall defining the associated groove 32 of the retainer 30, the elastic element 46 is compressed to absorb the excessive amount of rotational force (see FIG. 7). Since the elastic element 46 is compressed, a sliding action is generated between each ball 24 and the bottom wall defining the associated groove 32 of the retainer 30. Each ball 24 is thus disengaged from the associated groove 32 of the retainer 30, and the casing 40 and the pressing member 20 slide relative to the retainer 30; namely, the retainer 30 and the rod 10 are not turned. As a result, the bolt is not turned. When the casing 40 is further turned, each ball 24 is moved to the next groove 32, as indicated by the phantom lines in FIG. 13. A "click" is generated when each ball 24 enters the next groove 32 under the action of the elastic element 46. The "click" also reminds the user of tightening of the bolt. The protrusions 52 of the lid 50 allow smooth relative pivotal movement between the casing 40 and the retainer 30. Thus, the casing 40 turns freely if the clockwise rotational force is greater than the engaging force. The stop members 70 and the stop sections 33 of the retainer 30 do not interfere with clockwise rotation of the casing 40.

Figure 14:
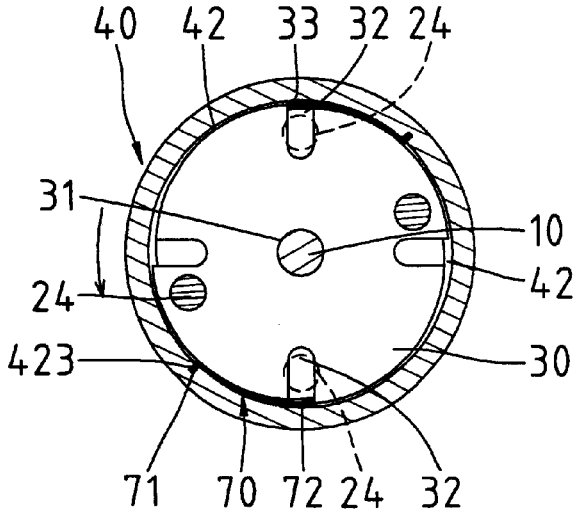
FIG. 14 is a view similar to FIG. 12, illustrating operation of the wrench in a reverse direction.

When loosening the bolt, the casing 40 is turned in a reverse direction, e.g., counterclockwise. In some cases the bolt rusts and thus could not be turned by the casing 40, as the casing 40 would slide. This is because the rotational force for driving the bolt would be greater than the predetermined engaging force. Nevertheless, provision of the stop members 70 and the stop sections 33 of the retainer 30 solve this problem. Referring to FIG. 14, when the casing 40 is turned in the counterclockwise direction, two of the stop sections 33 would be stopped by the stop members 70 and thus allow joint rotation of the casing 40 and the retainer 30 that is securely engaged with the rod 10. Thus, the rod 10 would be forced to turn. Namely, the bolt is turned by the rod 10 when the casing 40 is turned counterclockwise even if the rotational force is greater than the predetermined engaging force.

Figure 15:
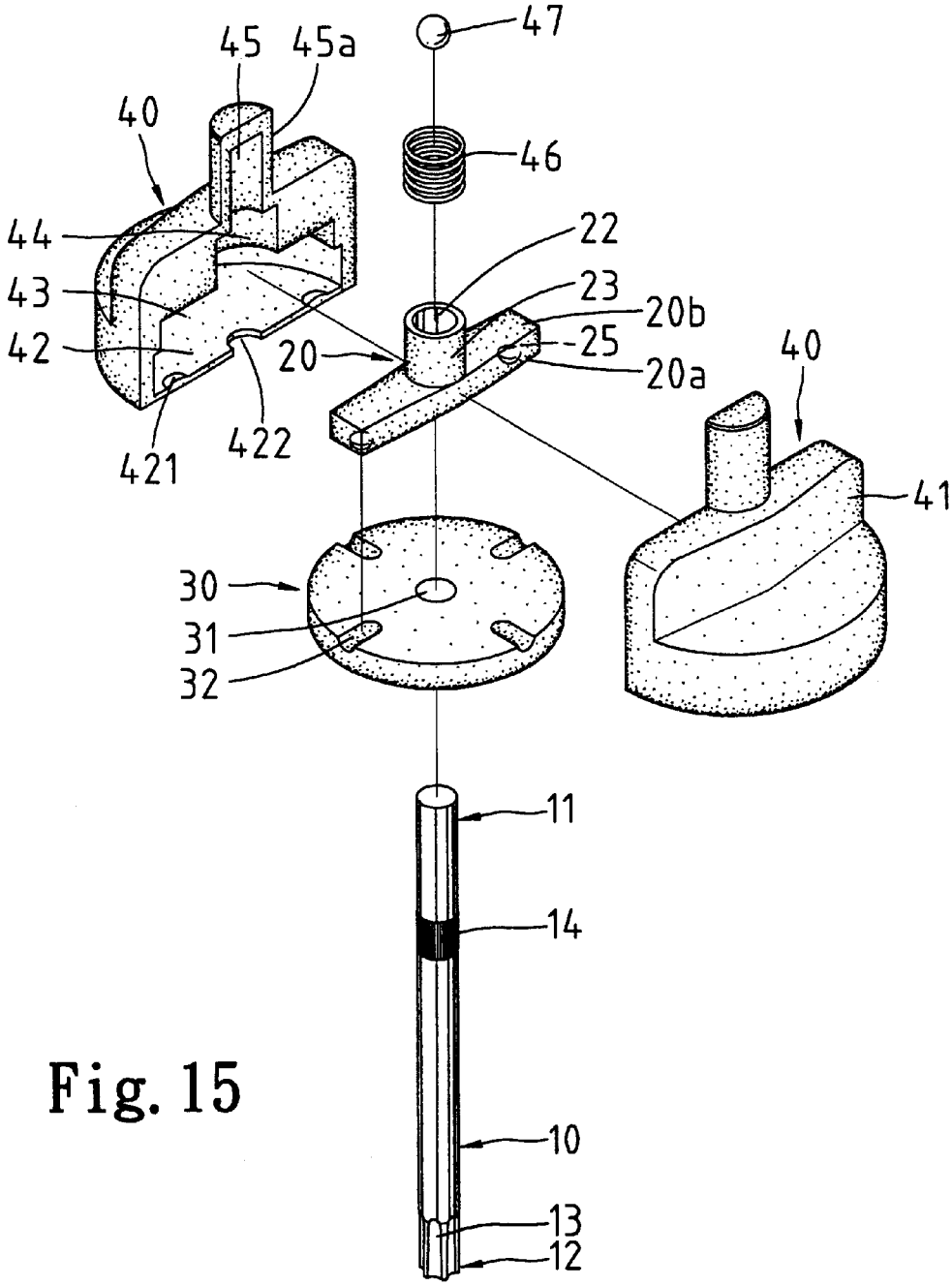
FIG. 15 is an exploded perspective view illustrating a further modified embodiment of the invention.
Figure 16A:
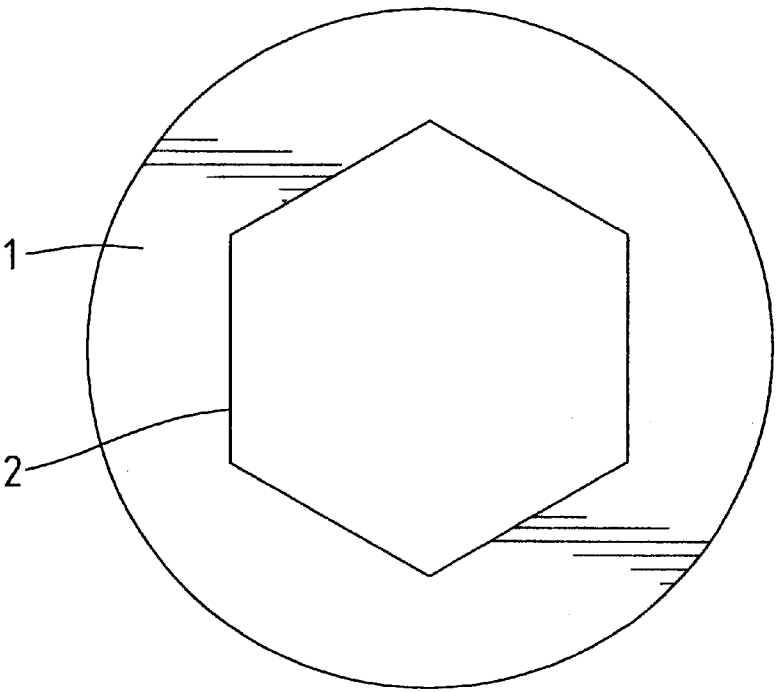
Fig. 16A PRIOR ART
FIG. 16A is an end view of a conventional hexagonal wrench.
Figure 16B:
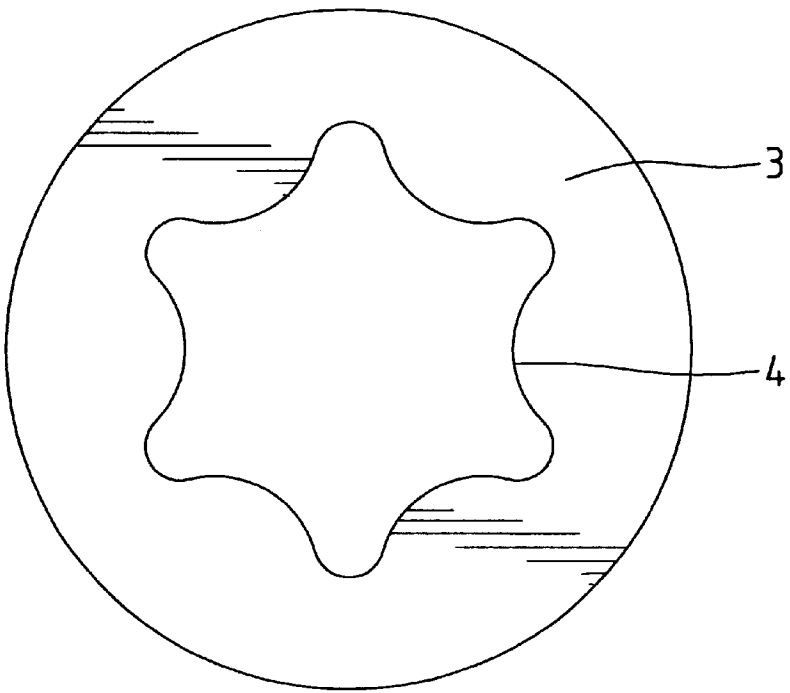
Fig. 16B PRIOR ART
FIG. 16B is an end view of a conventional TROX wrench.
Figure 17:
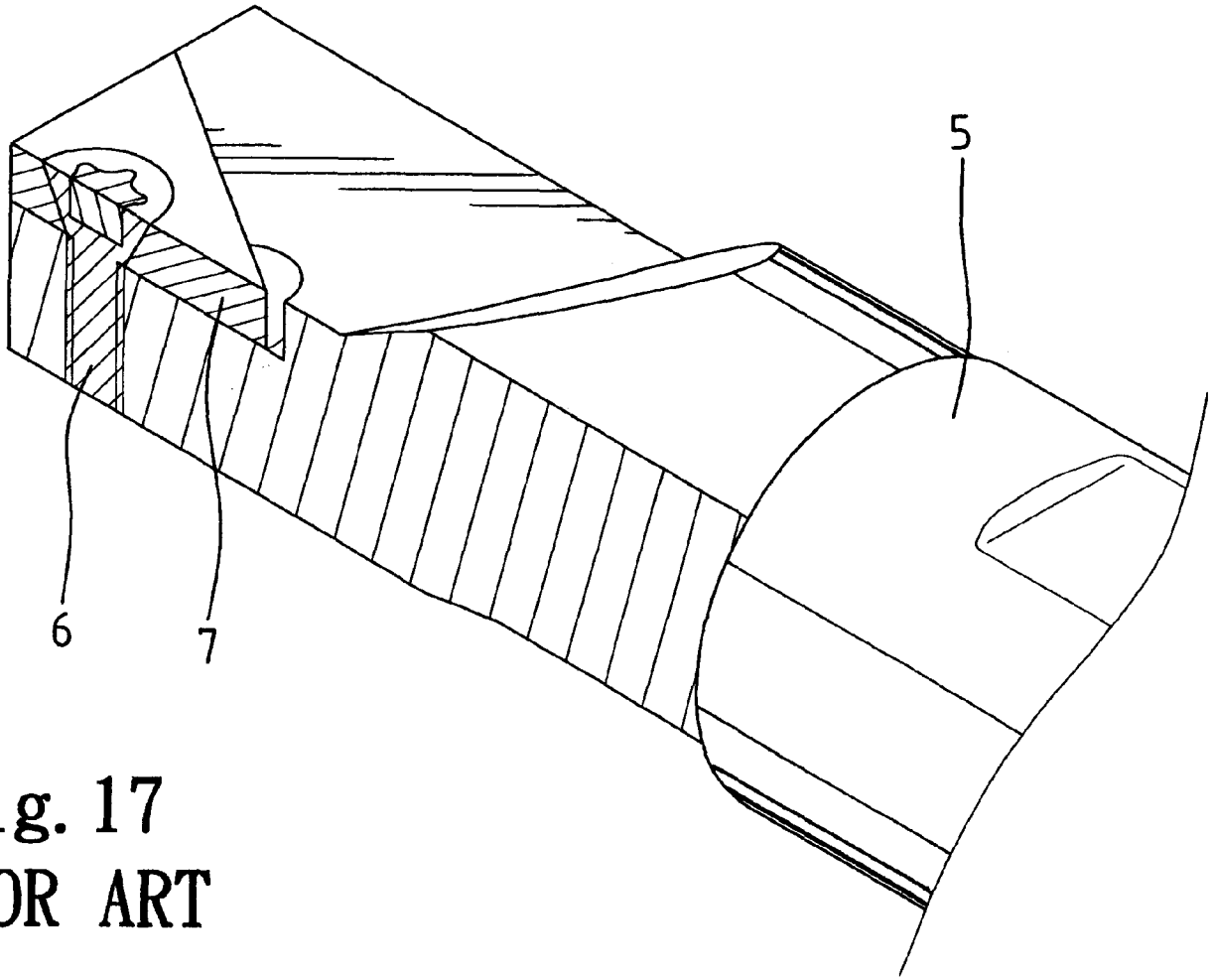
Fig. 17 PRIOR ART
FIG. 17 is a perspective view, partly cutaway, of a cutting tool.

FIG. 15 illustrates a further modified embodiment of the invention, wherein the retainer 30 includes a plurality of annularly spaced grooves 32, and the pressing member 20 includes at least one protrusion 25. The protrusion 25 of the pressing member 20 is moved from one groove 32 to another when the rotational force applied to the casing 40 is greater than the pre-determined engaging force. Of course, provision of the stop member 70 and stop section 36 of the retainer can be used in this embodiment.

Although the invention has been explained in relation to its preferred embodiment, it is to be understood that many other possible modifications and variations can be made without departing from the scope of the invention as hereinafter claimed.

What is claimed is:

1. A wrench comprising:

a rod comprising a driving portion on an end thereof for engaging with a fastener;

a retainer having a central portion securely mounted to the rod to turn therewith, the retainer including at least two pairs of retaining sections on a side thereof;

a casing comprising a receiving section for accommodating the retainer and allowing relative rotational movement between the casing and the retainer, the casing further comprising a compartment communicated with the receiving section;

a pressing member received in the compartment of the casing and slidable along a longitudinal direction of the rod, the pressing member being turned together with the casing when the casing is turned; and means for biasing two ends of the pressing member to respectively engage with one pair of the retaining sections of the retainer, thereby exerting an engaging force between each of the ends of the pressing member and an associated one of the retaining sections of the retainer;

wherein when a rotational force applied to the casing is smaller than the engaging force, the retainer and the rod are turned to thereby turn the fastener; and wherein when the rotational force applied to the casing is greater than the engaging force, the casing and the pressing member slide while the retainer and the rod are not turned.

2. The wrench as claimed in claim 1, wherein the ends of the pressing member slide to another pair of retaining sections of the retainer and generate a click to remind a user of tightening of the fastener driven by the rod.

3. The wrench as claimed in claim 1, wherein each of the retaining sections of the retainer includes a first groove, each of the ends of the pressing member including a second groove, further including a ball that is located between each said first groove and an associated one of the second grooves, the ball being biased by the biasing means to press against a bottom wall defining an associated one of the first grooves of the retainer.

4. The wrench as claimed in claim 1, wherein the central portion of the retainer has a hole through which the rod extends.

5. The wrench as claimed in claim 4, wherein the rod comprises an embossed section that is securely engaged in the hole of the retainer.

6. The wrench as claimed in claim 1, further comprising a lid for closing the receiving section.

7. The wrench as claimed in claim 6, wherein the lid comprises a hole through which the rod extends.

8. The wrench as claimed in claim 1, further comprising a support plate securely mounted in the casing, the support plate including at least one protrusion for supporting the retainer, thereby allowing smooth rotation of the casing relative to the retainer.

9. The wrench as claimed in claim 1, wherein the casing comprises a recessed portion surrounding the receiving section, further comprising a lid mounted in the recessed portion for closing the receiving section.

10. The wrench as claimed in claim 9, wherein the lid comprises a hole through which the rod extends.

11. The wrench as claimed in claim 9, further comprising a support plate securely mounted in the receiving section of the casing, the supporting plate including at least one protrusion for supporting the retainer, thereby allowing smooth rotation of the casing relative to the retainer.

12. The wrench as claimed in claim 1, wherein the casing comprises a central positioning hole for receiving another end of the rod.

13. The wrench as claimed in claim 12, further comprising a ball mounted between an end face of said another end of the rod and an end wall defining a portion of the central positioning hole.

14. The wrench as claimed in claim 12, wherein the central positioning hole of the casing comprises an enlarged section, the pressing member including an extension projecting from a side thereof, the extension being slidably received in the enlarged section of the positioning hole, the biasing means being an elastic element mounted around the extension and having a first end attached to an end face defining the enlarged section of the positioning hole and a second end attached to the side of the pressing member.

15. The wrench as claimed in claim 1, wherein the casing comprises a grip portion.

16. The wrench as claimed in claim 1, wherein the casing is comprised of two casing halves.

17. The wrench as claimed in claim 1, further comprising at least one stop member mounted in the casing, the retainer including at least one stop section on an outer periphery thereof, said at least one stop member and said at least one stop section being so configured that the retainer and the rod are turned to thereby turn the fastener when the rotational force applied to the casing in a first direction is smaller than the engaging force, that the casing slides while the retainer and the rod are not turned when the rotational force applied to the casing in the first direction is greater than the engaging force, and that the retainer and the rod are turned to thereby turn the fastener when the rotational force is applied in a second direction reverse to the first direction.

18. The wrench as claimed in claim 1, further comprising at least one stop member having a first end securely attached to a peripheral wall of the receiving section of the casing and a second end extending into the receiving section and along the peripheral wall of the receiving section, the retainer including at least one stop section on an outer periphery thereof, said at least one stop member and said at least one stop section being so configured that the retainer and the rod are turned to thereby turn the fastener when the rotational force applied to the casing in a first direction is smaller than the engaging force, that the casing slides while the retainer and the rod are not turned when the rotational force applied to the casing in the first direction is greater than the engaging force, and that the retainer and the rod are turned to thereby turn the fastener when the rotational force is applied in a second direction reverse to the first direction.

19. The wrench as claimed in claim 18, wherein the second end of said at least one stop member is stopped by said at least one stop section of the retainer, thereby allowing joint rotation of the retainer and the casing when the casing is turned in the second direction.

20. The wrench as claimed in claim 19, wherein said at least one stop member slides across said at least one stop section of the retainer when the casing is turned in the first direction.

21. A wrench comprising:

a rod comprising a driving portion on an end thereof for engaging with a fastener;

a retainer having a central portion securely mounted to the rod to turn therewith, the retainer including a plurality of annularly spaced retaining sections on a side thereof;

a casing comprising a receiving section for accommodating the retainer and allowing relative rotational movement between the casing and the retainer, the casing further including a compartment communicated with the receiving section;

a pressing member received in the compartment of the casing and slidable along a longitudinal direction of the rod, the pressing member being turned together with the casing when the casing is turned, the pressing member including at least one engaging member; and means for biasing said at least one engaging member of the pressing member to selectively engage with at least one of the retaining sections of the retainer, thereby exerting an engaging force between said at least one engaging member of the pressing member and said at least one of the retaining sections of the retainer;

wherein when a rotational force applied to the casing is smaller than the engaging force, the retainer and the rod are turned to thereby turn the fastener; and wherein when the rotational force applied to the casing is greater than the engaging force, the casing slides and said at least one engaging member slides to another one of the retaining sections of the retainer while the retainer and the rod are not turned.

22. The wrench as claimed in claim 21, wherein a click is generated to remind a user of tightening of the fastener driven by the rod when said at least one engaging member slides to another one of the retaining sections of the retainer.

23. The wrench as claimed in claim 21, wherein each of the retaining sections of the retainer includes a first groove, the pressing member including at least one second groove, said at least one engaging member being a ball that is located between said at least one second groove and an associated one of the first grooves, said ball being biased by the biasing means to press against a bottom wall defining an associated one of the first grooves.

24. The wrench as claimed in claim 21, wherein the central portion of the retainer has a hole through which the rod extends.

25. The wrench as claimed in claim 24, wherein the rod comprises an embossed section that is securely engaged in the hole of the retainer.

26. The wrench as claimed in claim 21, further comprising a lid for closing the receiving section.

27. The wrench as claimed in claim 26, wherein the lid comprises a hole through which the rod extends.

28. The wrench as claimed in claim 21, further comprising a support plate securely mounted in the casing, the support plate including at least one protrusion for supporting the retainer, thereby allowing smooth rotation of the casing relative to the retainer.

29. The wrench as claimed in claim 21, wherein the casing comprises a recessed portion surrounding the receiving section, further comprising a lid mounted in the recessed portion for closing the receiving section.

30. The wrench as claimed in claim 29, wherein the lid comprises a hole through which the rod extends.

31. The wrench as claimed in claim 30, further comprising a support plate securely mounted in the receiving section of the casing, the supporting plate including at least one protrusion for supporting the retainer, thereby allowing smooth rotation of the casing relative to the retainer.

32. The wrench as claimed in claim 21, wherein the casing comprises a central positioning hole for receiving another end of the rod.

33. The wrench as claimed in claim 32, further comprising a ball mounted between an end face of said another end of the rod and an end wall defining a portion of the central positioning hole.

34. The wrench as claimed in claim 33, wherein the central positioning hole of the casing comprises an enlarged section, the pressing member including an extension projecting from a side thereof, the extension being slidably received in the enlarged section of the positioning hole, the biasing means being an elastic element mounted around the extension and having a first end attached to an end face defining the enlarged section of the positioning hole and a second end attached to the side of the pressing member.

35. The wrench as claimed in claim 21, wherein the casing comprises a grip portion.

36. The wrench as claimed in claim 21, further comprising at least one stop member mounted in the casing, the retainer including at least one stop section on an outer periphery thereof, said at least one stop member and said at least one stop section being so configured that the retainer and the rod are turned to thereby turn the fastener when the rotational force applied to the casing in a first direction is smaller than the engaging force, that the casing slides while the retainer and the rod are not turned when the rotational force applied to the casing in the first direction is greater than the engaging force, and that the retainer and the rod are turned to thereby turn the fastener when the rotational force is applied in a second direction reverse to the first direction.

37. The wrench as claimed in claim 21, further comprising at least one stop member having a first end securely attached to a peripheral wall of the receiving section of the casing and a second end extending into the receiving section and along the peripheral wall of the receiving section, the retainer including at least one stop section on an outer periphery thereof, said at least one stop member and said at least one stop section being so configured that the retainer and the rod are turned to thereby turn the fastener when the rotational force applied to the casing in a first direction is smaller than the engaging force, that the casing slides while the retainer and the rod are not turned when the rotational force applied to the casing in the first direction is greater than the engaging force, and that the retainer and the rod are turned to thereby turn the fastener when the rotational force is applied in a second direction reverse to the first direction.

38. The wrench as claimed in claim 37, wherein the second end of said at least one stop member is stopped by said at least one stop section of the retainer, thereby allowing joint rotation of the retainer and the casing when the casing is turned in the second direction.

39. The wrench as claimed in claim 38, wherein said at least one stop member slides across said at least one stop section of the retainer when the casing is turned in the first direction.

* * * * *